US005251282A

United States Patent [19]

Hanning et al.

[11] Patent Number: 5,251,282

[45] Date of Patent: Oct. 5, 1993

[54] ELECTRIC WATER HEATER WITH IMPROVED INSULATION STRUCTURE AND CONTROL PANEL HOUSING ARRANGEMENT

[75] Inventors: David M. Hanning, Montgomery; Timothy E. Powell, Tallassee, both of Ala.

[73] Assignee: Rheem Manufacturing Company, New York, N.Y.

[21] Appl. No.: 20,331

[22] Filed: Feb. 19, 1993

[51] Int. Cl.[5] ..... F22B 37/26; H05B 1/02; F24H 1/20

[52] U.S. Cl. ..... 392/449; 122/131; 122/494; 126/361; 126/373; 165/136; 220/444; 220/902; 392/451

[58] Field of Search ..... 392/449–464; 220/444, 902; 122/494, 13.1, 13.2; 126/361, 362, 373, 374, 375; 165/136

[56] References Cited

U.S. PATENT DOCUMENTS

| | | | |
|---|---|---|---|
| 1,985,831 | 12/1934 | Hynes | 392/461 |
| 2,213,464 | 9/1940 | Fogwell | 392/451 |
| 2,376,537 | 5/1945 | Hall | 392/452 |
| 2,486,675 | 11/1949 | Pokras . | |
| 2,575,150 | 11/1951 | Wellman . | |
| 2,660,657 | 11/1953 | Ostrander | 392/451 X |
| 2,686,249 | 8/1954 | Hoague et al. . | |
| 3,043,467 | 7/1962 | Schwebel | 392/459 |
| 3,217,138 | 11/1965 | Drugmand . | |
| 3,253,731 | 5/1966 | Fink et al. | 220/444 |
| 3,992,608 | 11/1976 | Snaveley . | |
| 4,744,488 | 5/1988 | Nelson | 220/444 |
| 4,878,459 | 11/1989 | Nelson | 122/494 |
| 5,052,346 | 10/1991 | Beck | 122/494 |
| 5,101,471 | 3/1992 | Bill | 126/374 X |
| 5,163,119 | 11/1992 | Windon | 392/449 |

*Primary Examiner*—Anthony Bartis
*Attorney, Agent, or Firm*—Konneker, Bush & Hitt

[57] ABSTRACT

The external jacket structure of an electric water heater defines with the water storage tank portion thereof a hollow insulation space that horizontally circumscribes and extends across the top end of the tank. A fiberglass foam stop block member is pressed between the tank and jacket and has a cutout area through which an immersion heating element end connector is exposed to a first jacket sidewall opening normally covered by a removable access panel. A control panel mounted externally on the jacket above the first jacket sidewall opening has a bottom interior portion that downwardly overlaps a top portion of the cutout area and communicates therewith through a second jacket opening. An electrical control component disposed in an upper interior portion of the control panel is operatively connected to the heating element end connector by electrical wiring extending from the control component sequentially through the control panel interior, inwardly through the second jacket sidewall opening, and through the foam stop block member cutout area. The hollow insulation space between the tank and jacket is filled with a hardened foam insulation material injected into the insulation space through the jacket at a point thereon disposed outwardly of the exterior edge periphery of the foam stop block member.

8 Claims, 2 Drawing Sheets

ELECTRIC WATER HEATER WITH IMPROVED INSULATION STRUCTURE AND CONTROL PANEL HOUSING ARRANGEMENT

BACKGROUND OF THE INVENTION

The present invention relates generally to water heaters, and more particularly relates to improvements in the external thermal insulation of hot water storage tank portions of electric water heaters.

In one common form thereof, a modern electric water heater comprises a cylindrical metal tank, in which water to be heated is stored, and one or more electric immersion heating elements extending horizontally through a lower end portion of the tank and having an electrical connector portion disposed on the outer side of the tank. Outwardly circumscribing the tank is a larger diameter cylindrical metal jacket structure that defines around the side surface and top end portions of the tank a hollow insulation space.

In conventionally constructed electric water heaters of this type, a large jacket sidewall opening is circumferentially aligned with the heating element connector portions and vertically extends from a point slightly below the connectors to a point substantially higher than the connectors. Installed outwardly over this large jacket opening is a control panel in an upper portion of which are disposed various electrical control components used to regulate the operation of the immersion heating elements.

With the jacket structure installed outwardly around the storage tank, the water heater is insulated by injecting a suitable foam insulating material into the cavity defined between the jacket structure and the tank. To prevent the injected foam insulation from being forced outwardly through the jacket sidewall opening a fiberglass foam stop block member is suitably affixed to the outer side of the tank, over the heating element connector portions, prior to the installation of the jacket structure and the subsequent injection of the insulating foam.

The installed foam stop block member has a cutout area through which the heating element connector portions are exposed to the jacket sidewall opening. The periphery of the control panel, at its juncture with the outer side surface of the jacket structure, is positioned circumferentially and vertically inwardly of the outer side edge periphery of the foam stop block member, and the periphery of the stop member cutout area is positioned circumferentially and vertically inwardly of the control panel periphery, with the top side edge portion of the cutout area being downwardly spaced a slight distance from the top side of the control panel. Accordingly, an upper portion of the fiberglass foam stop block member is interposed between the panel-mounted control components and the hot side surface of the storage tank.

When the foam is injected into the hollow insulation space between the tank and jacket structure, the outer edge periphery of the foam stop block member serves as a foam barrier to prevent the foam from entering the cutout area and passing outwardly through the large jacket sidewall opening into the control panel. The panel-mounted electrical control components are operatively interconnected with the heating element connector portions by wires that extend from the control components downwardly through the control panel interior and into the foam stop block member cutout area through the jacket sidewall opening.

From an insulation standpoint, this conventional electric water heater construction has two primary disadvantages. First, as previously mentioned, the fiberglass foam stop block member is interposed between the panel-mounted electrical control components and the side surface of the storage tank. Because the fiberglass member has a lower thermal resistivity than that of the injected foam, the control components are undesirably exposed to higher operating temperatures (from the storage tank heat) than they would otherwise be if they were positioned outwardly over the foam insulation.

Second, due to the relative orientations of the control panel, the jacket opening and the foam stop member cutout area, it is necessary to make the height of the stop member quite large relative to the overall height of the water heater. This results in the fiberglass stop member occupying a substantial portion of the insulation space between the storage tank and the jacket structure. Since the thermal resistance of the fiberglass stop member is substantially less than that of the hardened foam insulation, the overall thermal resistivity of the tank insulation system is correspondingly reduced (compared to what it would be if a greater percentage of the insulation cavity was occupied by hardened foam), thereby permitting a greater amount of stored water heat to escape outwardly through the jacket structure.

It can be seen from the foregoing that it would be desirable to provide an electrical water heater, of the general type described above, having an improved tank insulation structure. It is accordingly an object of the present invention to provide such a water heater.

SUMMARY OF THE INVENTION

In carrying out principles of the present invention, in accordance with a preferred embodiment thereof, an electric water heater having an improved insulation structure is fabricated using:

(1) a hot water storage tank having a top end, an exterior side surface, a bottom end portion, and an electric immersion heating element extending through the bottom end portion and having an end connector disposed on the exterior side surface of the tank;

(2) a foam stop block member having an exterior edge periphery and a cutout area disposed inwardly of its exterior edge periphery;

(3) a jacket structure having a first sidewall opening therein, and a second sidewall opening spaced upwardly apart from the first sidewall opening; and (4) a control panel having a periphery, top and bottom sides, and an electrical control component mounted in an upper portion thereof.

The foam stop block member, preferably of a fiberglass material, is secured to the exterior side surface of the tank in a manner such that the end connector of the immersion heating element is exposed through the cutout area. The jacket structure is then installed outwardly around the hot water storage tank in a manner such that the foam stop block member is pressed between the jacket structure and the tank, and the installed jacket structure defines with a tank a hollow insulation space that outwardly circumscribes the tank.

The installed jacket structure is oriented relative to the tank in a manner such that the peripheries of the first and second jacket structure sidewall openings are disposed horizontally inwardly of the exterior edge periphery of the foam stop block member, with a top side of the cutout area periphery being disposed above the second jacket structure sidewall opening, and a bottom side edge portion of the first jacket structure side wall opening being disposed below the bottom side of the cutout area periphery and above the bottom of the foam stop block member.

A suitable foam insulation material is injected into the hollow insulation space through the jacket structure at a point thereon disposed outwardly of the exterior edge periphery of the foam stop block member. The foam stop block member serves as a barrier within the hollow insulation space to prevent the foam being injected into such space from being forced into the cutout area and outwardly through the first and second jacket structure sidewall openings.

The control panel is mounted on the outer side of the jacket structure in a manner such that the bottom side of the control panel is vertically positioned between the first and second jacket structure sidewall openings, the electrical control component within the panel is positioned above the foam stop block member, and an upper portion of the cutout area communicates with the interior of the control panel through the second jacket structure sidewall opening. The control component within the panel is interconnected with the heating element end connector by electrical wiring extending from the control component sequentially through the interior of the control panel, inwardly through the second jacket structure sidewall opening, and through the foam stop block member cutout area.

The relative orientations of the foam stop block member, the jacket sidewall openings and the control panel provide the improved water heater with several advantages over conventionally insulated electric water heaters.

First, the foam stop block member can be given a substantially shorter height which results in a substantially greater percentage of the hollow insulation space between the jacket and tank being filled with the insulating foam. Since the thermal resistance of the hardened foam is substantially greater than that of the fiberglass foam stop block, the overall thermal resistance of the tank insulation system is correspondingly increased.

Second, in the improved electrical water heater of the present invention a layer of the hardened insulating foam, as opposed to the fiberglass foam stop block member, is interposed between the electrical control component and the tank. Accordingly, appreciably less storage tank heat is conducted to the control component within the panel, and its operating temperature is desirably reduced.

Third, despite the fact that the bottom side of the control panel is positioned above the heating element end connector the wiring from the panel mounted control component need not be routed exteriorly along the jacket to the end connector. Instead, due to the use of the second jacket structure sidewall opening, and its positional relationship to the control panel and the foam stop block member cutout area this wiring is protectively and completely concealed within the interiors of the control panel and the foam stop block member cutout area.

DETAILED DESCRIPTION

Figure 1:
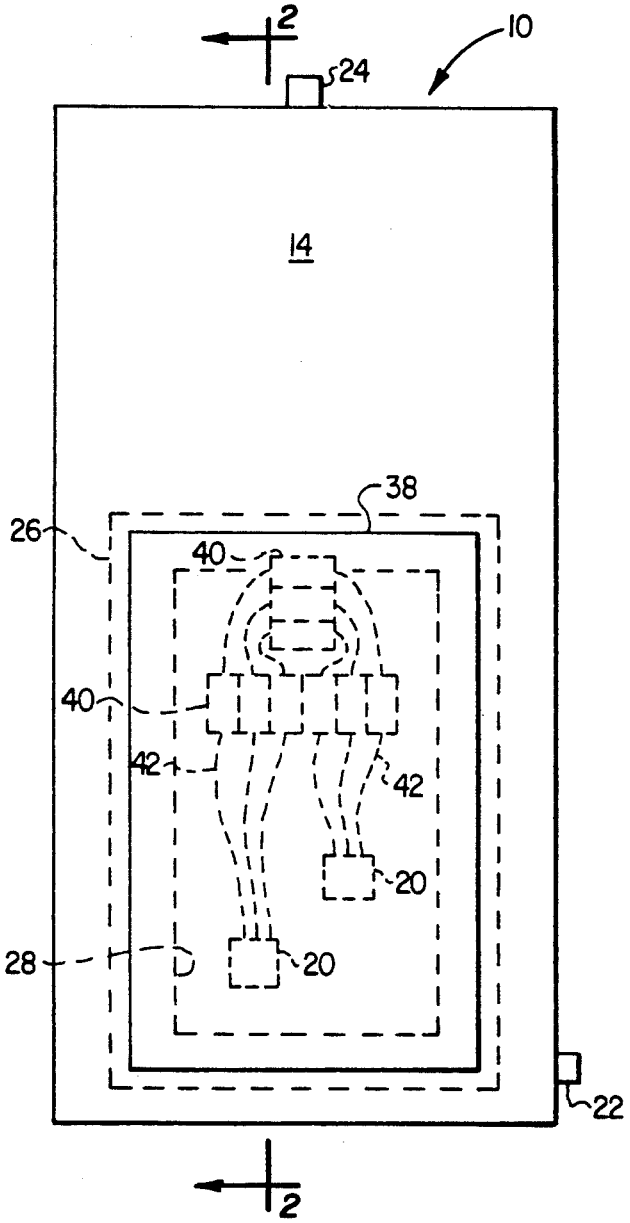
FIG. 1 (PRIOR ART)
FIG. 1 (Prior Art) is a schematic front side elevational view of a conventionally insulated electric water heater.
Figure 2:
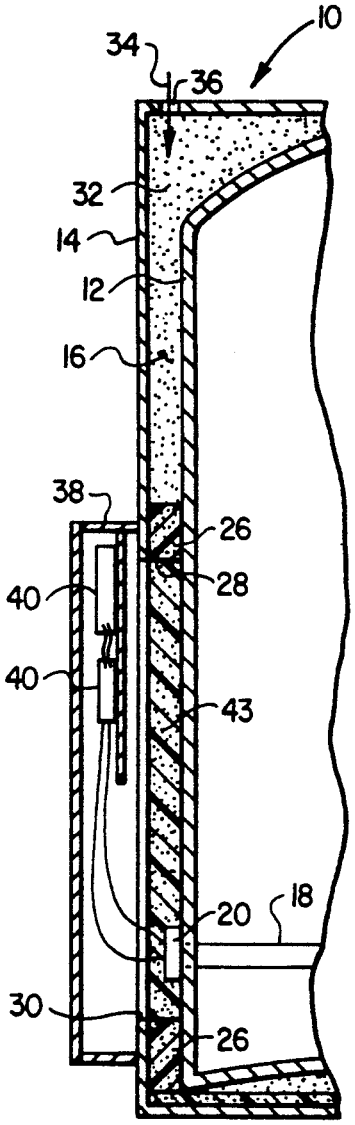
FIG. 2 (PRIOR ART)
FIG. 2 (Prior Art) is a schematic cross-sectional view through the conventional electric water heater taken along line 2—2 of FIG. 1.

Illustrated in FIGS. 1 and 2 (Prior Art) is a conventionally insulated electric water heater 10 having a hot water storage tank 12 outwardly surrounded by a metal jacket structure 14 that defines with the exterior of the tank 12 a hollow, enclosed insulation space 16 that horizontally circumscribes and extends along the top end of the storage tank. Extending inwardly into a bottom end portion of the tank 12 are electric resistance type immersion heating elements 18 having electrical end connection portions 20 mounted on the front side of the tank 12. At the bottom end of the tank 12 is a cold water inlet fitting 22 through which water to be heated is delivered to the tank for heating by the electric elements 18 and discharged from the tank through an outlet fitting 24 at its top end.

In constructing the conventional electric water heater 10, a rectangular fiberglass foam stop block member 26, having a rectangular cutout area 28 therein, is suitably secured to the front side of the tank 12 with the heating element connector portions 20 positioned within the cutout area 28. The jacket structure 14 is then positioned outwardly around the tank 12 and the foam stop block member 26. As illustrated, a rectangular opening 30 is formed through a front side of the jacket structure 14 and outwardly overlies the foam stop block member 26, with the periphery of the opening 30 being spaced slightly inwardly from the periphery of the foam stop block member 26.

With the fiberglass foam stop block member 26 operatively in place between the tank 12 and the jacket structure 14, liquid insulating foam 32 is injected into the hollow insulation space 16 between the tank 12 and jacket structure 14, as indicated by the arrow 34 in FIG. 2, through a small opening 36 in the top end of the jacket that is suitably plugged after the foam injection process is completed. The edge periphery of the installed fiberglass member 26 acts as a barrier that prevents the liquid insulation foam 32 from being forced into the cutout area 28 and outwardly through the large jacket opening 30. When the injected foam 32 hardens it peripherally encapsulates the foam stop member 26 and holds it firmly in place behind the jacket opening 30.

A control panel 38, having conventional electrical power and control components 40 mounted therein, is externally secured to the front side of the jacket structure 14 around the opening 30 therein. The components 40 and the electrical connector portions 20 are operatively connected by wiring 42 extended from the components 40 to the connector portions 20 through the interior of the control panel 38 and the cutout area 28 in the fiberglass foam stop block member 26. As illustrated in FIG. 2, fiberglass insulating blanket material 43 is positioned within the cutout area 28 of the foam stop block member 26.

This conventional method of insulating the electric water heater 10 presents two primary disadvantages.

First, it can be seen that the fiberglass foam stop member 26 and the fiberglass insulating blanket material 43 occupy a substantial portion of the insulation space 16 between the tank 12 and the jacket structure 14. Since the thermal resistance of the fiberglass member 26 and the fiberglass blanket material 43 is substantially less than that of the hardened foam 32, the overall thermal resistance of the tank insulation system is correspondingly reduced (compared to what it would be if a greater percentage of the insulation space 16 was occupied by hardened foam 32), thereby permitting a greater amount of stored water heat to escape outwardly through the jacket structure 14.

Second, it can be seen that an upper portion of the fiberglass foam stop member 26 is interposed between the electrical power and control components 40 and the tank 12. In the conventionally constructed water heater 10 this, of course, is necessary to keep the foam 32 being injected into the insulation space 16 from being forced into the interior of the control cabinet 38 through the jacket opening 30. However, since the fiberglass member 26 (as well as an upper portion of the fiberglass blanket material 43) is positioned behind the components 40 they are exposed to a higher operating temperature than they would be if they were positioned over the higher thermal resistance foam 32.

Figure 3:
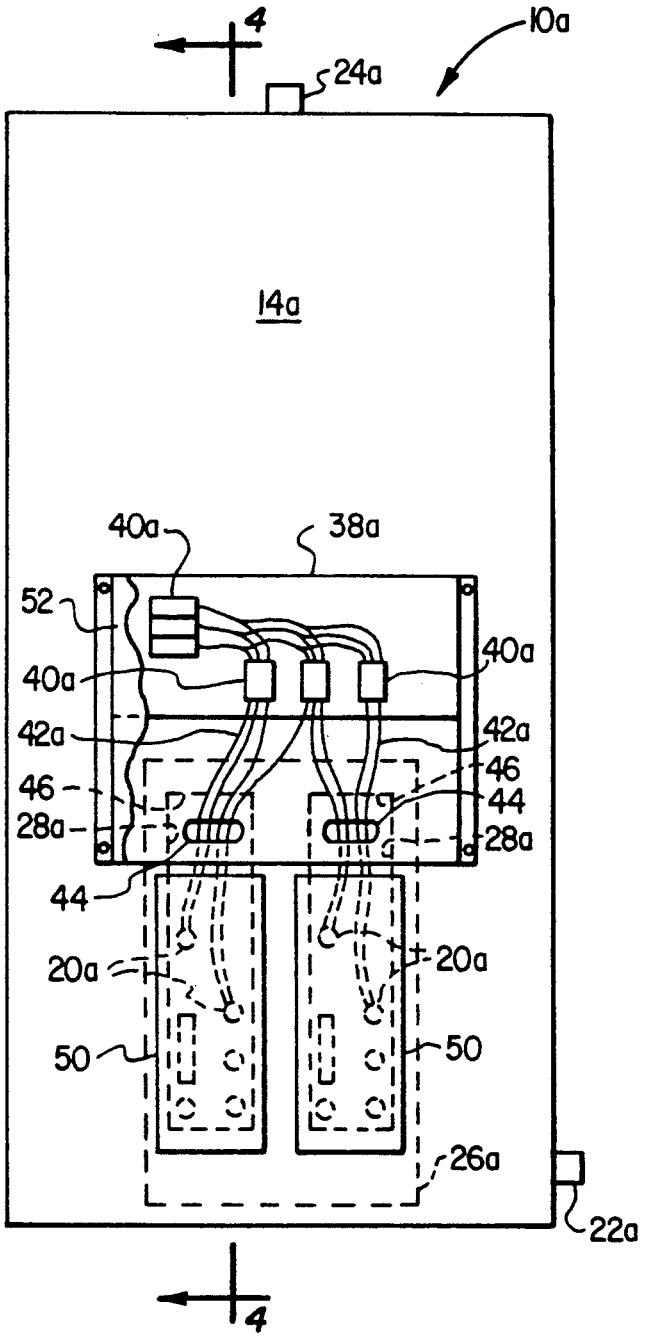
FIG. 3 is a schematic, partially cut away front side elevational view of an improved electric water heater incorporating therein insulation principles of the present invention.
Figure 4:
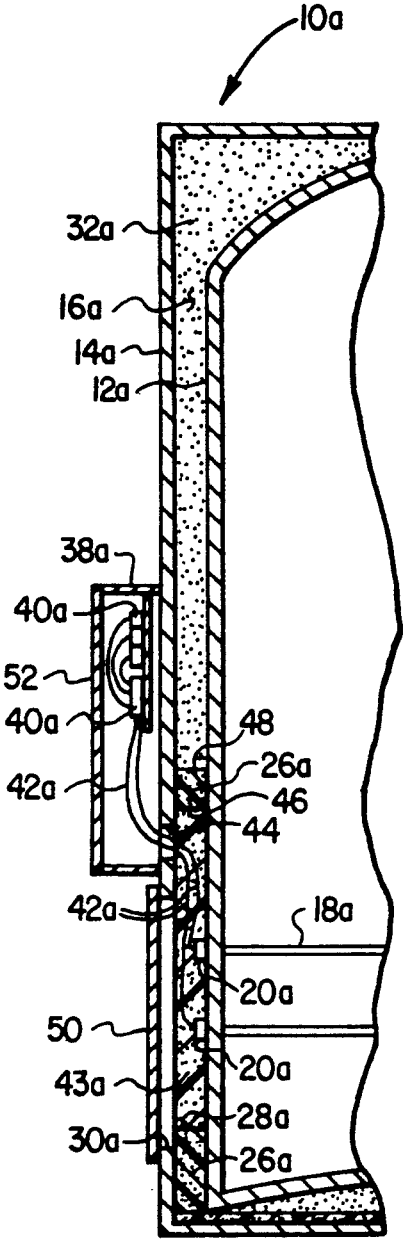
FIG. 4 is a schematic cross-sectional view through the improved water heater taken along line 4—4 of FIG. 3.

Turning now to FIGS. 3 and 4, the present invention provides an electric water heater **10*a* which, compared to its conventional counterpart 10 shown in FIGS. 1 and 2, has a substantially improved tank insulation structure. For purposes of easy comparison of the water heaters 10 and 10*a* they have been shown as being of the same storage capacity (representatively 85 gallons), and the components in the improved water heater 10*a* similar to those in the conventionally insulated water heater 10** have been given the same reference numerals, but with the subscripts "a".

As will now be described, the substantially improved tank insulation incorporated in the water heater **10*a* is uniquely achieved simply by modifying the vertical sizes and relative arrangements of the foam stop block member 26*a*, the control panel 38*a*, and the jacket opening 30*a* compared to their counterparts in the conventional water heater 10, and forming an additional pair of representatively elliptical openings 44 in the jacket 14*a***.

By comparing FIGS. 2 and 4 it can be seen that the control panel **38*a* has been upwardly shortened relative to the control panel 38; each jacket opening 30*a* (a side-by-side pair of which are representatively used in the water heater 10*a*) has been downwardly shortened relative to the jacket opening 30; and the foam stop block member 26*a* has been downwardly shortened relative to the foam stop block member 26. Additionally, two cutout areas 28*a* are formed in the foam stop block member 26*a*. However, if desired, these two cutout areas could be replaced by a single, larger cutout area (as in the case of the foam stop block member 26). The cutout areas 28*a* are filled with fiberglass insulating blanket material 43*a***.

The bottom side of the control panel **38*a* is disposed slightly above the top side edge of the jacket opening 30*a* and just below the two elliptical jacket openings 44. The top side edges 46 of the foam stop block member cutout areas 28*a* are positioned just above the jacket openings 44, and the top side edge 48 of the foam stop block member 26*a* is positioned below the electrical power and control components 40*a*. Accordingly, the interior of the control panel 38*a* is communicated with the interior of the cutout areas 28*a* through the elliptical jacket openings 44. The jacket openings 30*a* outwardly overlie the cutout areas 28*a* and are normally covered by a pair of removable access plates 50 removably secured to the outer side of the jacket 14*a***.

In constructing the improved water heater **10*a*, the foam stop block member 26*a* is suitably secured to the front side of the tank 12*a* with the heating element connector portions 20*a* being positioned within the cutout areas 28*a* and the jacket openings 30*a* outwardly overlying the cutout areas 28*a*. The jacket structure 14*a* is then positioned outwardly around the tank 12*a* and the foam stop block member 26*a*. The control panel 38*a* is then secured in place on the outer side of the jacket 14*a*. Access to the interior of the control panel 38*a* is provided by a front door portion 52** thereof.

After the control panel **38*a* is operatively mounted on the jacket 14*a*, outer ends of appropriate ones of the wires 42*a* from the electrical components 40*a* are sequentially passed downwardly through the control panel interior, inwardly into the cutout areas 28*a* through the jacket openings 44, and downwardly through the cutout areas 28*a* to the electrical connector portions 20*a*. Using the jacket openings 30*a* to gain access to the connector portions 20*a*, the lower ends of the wires 42*a* are then operatively secured to the connector portions 20*a* and the access plates 50 are secured in place over the jacket openings 30*a***.

Liquid insulating foam **32*a* is then injected into place within the hollow insulation space 16*a* as previously described for the conventional water heater 10 and hardens around and encapsulates the exterior periphery of the foam stop block member 26*a* which serves to prevent the injected foam insulation 32*a* from entering the cutout areas 28*a* and passing outwardly through any of the jacket openings 30*a* and 44**.

The relative orientations of the foam stop block member **26*a*, the jacket openings 30*a* and 44, and the control panel 38*a* provide the improved water heater 10*a* with several advantages over the conventional water heater 10. For example, the vertical shortening of the foam stop block member 26*a* results in a substantially greater percentage of the hollow insulation space 16*a* being filled with the insulating foam 32*a*. Since the thermal resistance of the hardened foam 32*a* is substantially greater than that of the fiberglass block 26*a*, the overall thermal resistance of the tank insulation system is correspondingly increased compared to that of the conventional water heater 10**.

Furthermore, as can be seen by comparing FIGS. 2 and 4, in the water heater **10*a* a layer of the hardened insulating foam 32*a* is interposed between the electrical components 40*a* and the tank 12*a*, whereas in the water heater 10 a section of the fiberglass block 26 is positioned between the electrical components 40 and the tank 12. Thus, appreciably less storage tank heat is conducted to the electrical components 40*a*** and their operating temperature is desirably lessened.

Additionally, despite the fact that the bottom side of the control panel **38*a* is positioned above the electrical connectors 20*a* the wires 42 need not be routed exteriorly along the jacket 14*a* to the connectors 20*a*. Instead, due to the use of the auxiliary jacket openings 44 and their positional relationship to the control panel 38*a* and the cutout areas 28*a* the wires 42 are protectively and completely concealed within the interiors of the control panel 38*a* and the cutout areas 28*a***.

The foregoing detailed description is to be clearly understood as being given by way of illustration and example only, the spirit and scope of the present invention being limited solely by the appended claims.

What is claimed is:

1. An electric water heater comprising:

a hot water storage tank having upper and lower ends;

an electric resistance heating element extending generally horizontally through a lower interior end portion of said tank and having an electrical end connector portion exteriorly mounted on said tank;

a jacket structure extending around said tank in an outwardly spaced relationship therewith, said tank and said jacket structure forming therebetween a hollow insulation space that horizontally circumscribes and extends across the top end of said tank, said jacket structure having a first opening formed therethrough in general outward alignment with said end connector portion, and a second opening formed therethrough and being upwardly spaced apart from said first opening;

a foam stop member interposed between said jacket structure and said tank within said insulation space at said end connector portion, said foam stop member having:

an edge periphery outwardly circumscribing said end connector portion and having an upper end portion disposed above said second jacket structure opening and a lower end portion disposed below said first jacket structure opening, and a cutout area, disposed inwardly of said edge periphery, through which said end connector portion is exposed to said first jacket structure opening, said cutout area having an upper end surface portion positioned upwardly adjacent said second jacket structure opening;

a hardened foam insulation material disposed within and essentially filling the portion of said insulation space not occupied by said foam stop member, said hardened foam insulation material extending peripherally around said foam stop member and having a thermal resistivity appreciably higher than that of said foam stop member;

a control panel housing exteriorly mounted on said jacket structure and having:

a top end disposed above said upper end portion of said edge periphery of said foam stop member, a bottom end disposed between said first and second jacket structure openings, and a lower interior end portion communicating with an upper end portion of said foam stop member cutout area through said second jacket structure opening;

an electrical control component disposed within an interior portion of said control panel housing positioned above said foam stop member, whereby a portion of said hardened foam insulation material is interposed between said electrical component and said tank; and electrical wiring operatively interconnecting said electrical control component and said end connector portion, said electrical wiring extending from said electrical control component to said end connector portion sequentially through the interior of said control panel housing, said second jacket structure opening, and said foam stop member cutout area.

2. The electric water heater of claim 1 wherein:

said foam stop member has a lower thermal resistivity than the thermal resistivity of said hardened foam insulation material.

3. The electric water heater of claim 2 wherein:

said foam stop member is formed from a fiberglass material.

4. The electric water heater of claim 1 wherein:

said hot water storage tank and said jacket structure have generally cylindrical configurations.

5. A method of fabricating an electric water heater, said method comprising the steps of:

providing a hot water storage tank having a top end, an exterior side surface, a bottom end portion, and an electric immersion heating element extending through said bottom end portion and having an end connector portion disposed on said exterior side surface;

providing a foam stop block member having an exterior edge periphery and a cutout area disposed inwardly of said exterior edge periphery;

securing said foam stop block member to said exterior side surface of said hot water storage tank in a manner such that said connector portion of said electric immersion heating element is exposed through said cutout area;

providing a jacket structure having a first sidewall opening therein, and a second sidewall opening spaced upwardly apart from said first sidewall opening;

installing said jacket structure outwardly around said hot water storage tank in a manner such that said foam stop block member is pressed between said jacket structure and said hot water storage tank, and the installed jacket structure defines with said hot water storage tank a hollow insulation space that outwardly circumscribes said hot water storage tank, the installed jacket structure being oriented relative to said hot water storage tank in a manner such that the peripheries of said first and second jacket structure sidewall openings are disposed horizontally inwardly of said exterior edge periphery of said foam stop block member, with a top side of the cutout area periphery being disposed above said second jacket structure sidewall opening, and a bottom side edge portion of said first jacket structure sidewall opening being disposed below the bottom side of the cutout area periphery and above the bottom of said foam stop block member;

providing a control panel having a periphery, top and bottom sides, and an electrical control component mounted in an upper portion thereof;

mounting said control panel on the outer side of said jacket structure in a manner such that said bottom side of said control panel is vertically positioned between said first and second jacket structure sidewall openings, said electrical control component is positioned above said foam stop block member, and an upper portion of said cutout area communicates with the interior of said control panel through said second jacket structure sidewall opening;

interconnecting said control component with said end connector portion of said immersion heating element with electrical wiring extending from said control component to said end connector portion sequentially through the interior of said control panel, inwardly through said second jacket structure sidewall opening, and through said cutout area; and injecting foam insulation into said hollow insulation space through said jacket structure at a point thereon disposed outwardly of said exterior edge periphery of said foam stop block member.

6. An electric water heater fabricated by the method of claim 5.

7. The method of claim 5 further comprising the step of:

removably securing an access panel to the exterior of said jacket structure over said first sidewall opening therein.

8. An electric water heater fabricated by the method of claim 7.

* * * * *